US005649848A

United States Patent [19]

Clark

[11] Patent Number: 5,649,848

[45] Date of Patent: Jul. 22, 1997

[54] REVERSIBLE PLUSH TOY

[76] Inventor: Stanton W. Clark, P.O. Box 6214, Bloomington, Ind. 47407

[21] Appl. No.: 604,826

[22] Filed: Feb. 23, 1996

[51] Int. Cl.[6] ..... A63H 3/12; A63H 3/00; A63H 3/02

[52] U.S. Cl. ..... 446/321; 446/368; 446/372

[58] Field of Search ..... 446/321, 320, 446/337, 338, 368, 369, 372

[56] References Cited

U.S. PATENT DOCUMENTS

| | | | |
|---|---|---|---|
| 2,274,303 | 2/1942 | Ornstein | 446/369 X |
| 3,831,316 | 8/1974 | Welstrop | 446/321 X |
| 4,336,665 | 6/1982 | Moreau | 46/153 |
| 4,614,505 | 9/1986 | Schneider et al. | 446/372 |
| 4,695,264 | 9/1987 | McLeod, Jr. | 446/321 |
| 4,734,075 | 3/1988 | Park | 446/321 |
| 4,739,529 | 4/1988 | Mills | 446/369 X |
| 4,781,648 | 11/1988 | Garfinkel | 446/321 |
| 5,090,938 | 2/1992 | Reynolds | 446/369 |
| 5,115,528 | 5/1992 | Lamle | 446/321 X |

FOREIGN PATENT DOCUMENTS

| | | | |
|---|---|---|---|
| 2649330 | 1/1991 | France | 446/321 |

*Primary Examiner*—Sam Rimell
*Assistant Examiner*—D. Neal Muir
*Attorney, Agent, or Firm*—Woodard, Emhardt, Naughton, Moriarty & McNett

[57] ABSTRACT

A reversible plush toy which has two designs, such as two animal shapes, which turn inside-out into each other by consuming and regurgitating each other through their wide mouth, which they share.

12 Claims, 6 Drawing Sheets

REVERSIBLE PLUSH TOY

TECHNICAL FIELD OF THE INVENTION

The present invention generally relates to plush toys and, more particularly, to a reversible plush toy.

BACKGROUND OF THE INVENTION

Plush toys, those having soft, generally fabric exteriors and sometimes stuffed with a padding material, have been popular with both children and adults since the nineteenth century. Such plush toys are generally formed in the shape of animals, the "teddy bear" being by far the most popular design.

Although plush toys are popular, there have been many attempts in the past to enhance the appeal of such toys to children by adding functional features to the toys. One such attempt has been the development of a number of plush toy designs that are in some way reversible. These designs allow the toy to be changed into a different toy by some physical manipulation of the toy. One such design is illustrated in U.S. Pat. No. 4,781,648 to Garfinkel. In this design, the toy is formed in a first animal shape having a zipper running the length of the first animal's back. When the zipper is unzipped, a second animal shape is revealed to be concealed within the toy. Inverting the zipper flaps so that they cover the front of the first animal and then closing the zipper transforms the toy completely into the second animal shape.

Another reversible toy design is disclosed in U.S. Pat. No. 4,695,264 to McLeod, Jr. This design is similar to the Garfinkel design, except that the zipper is located in the stomach of each animal, rather than in the animal's back.

Yet another reversible toy design is disclosed in U.S. Pat. No. 4,336,665 to Moreau. In this design, two heads are formed facing in opposite directions and having necks joined together at a common juncture. A reversible shell fabric cover is joined to the toy at the common juncture. By covering one of the heads with the shell so as to form a first body, a first toy design may be created. A second toy design is created by flipping the reversible shell so as to cover the other head, thereby forming a second body.

In each of these prior art reversible toy designs, the functionality of the toy is enhanced due to the reversability of the design. However, each of the prior art designs exhibit the serious flaw that they are unnatural and even grotesque. Real animals do not have zippers in their backs and stomachs from which emerge other animals. There is therefore a need in the prior art for a reversible toy design which incorporates the reversability function into a natural feature of the toy shape. The present invention is directed toward meeting this need.

SUMMARY OF THE INVENTION

The present invention relates to a reversible plush toy which has two designs, such as two animal shapes, which turn inside-out into each other by consuming and regurgitating each other through their wide mouth, which they share.

In one form of the invention, a reversible plush toy is disclosed, comprising a first figure having a hollow first shell and a first mouth; and a second figure having a hollow second shell and a second mouth; wherein the first and second mouths are coupled together, thereby coupling the first figure to the second figure, such that the second figure may be pushed through the first mouth and retained within the first shell and the first figure may be pushed through the second mouth and retained within the second shell.

DETAILED DESCRIPTION OF THE PREFERRED EMBODIMENTS

Figure 1:
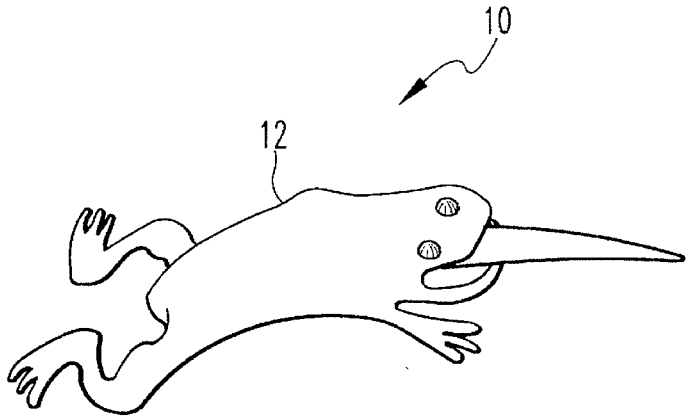
FIG. 1 is a perspective view of a first embodiment of the present invention having a first animal shape exposed.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention relates to a reversible plush toy which has two designs, such as two animal shapes, which turn inside-out into each other by consuming and regurgitating each other through their wide mouth, which they share. A first embodiment of the present invention is illustrated in FIGS. 1–4, in which the regurgitating and consuming process is sequentially illustrated. The reversible toy is indicated generally at 10 and includes a first animal shape 12, such as a frog, and a second animal shape 14, such as a salamander. In the view of FIG. 1, the toy 10 is in a position in which the frog 12 is exposed. In this position, a tail of the salamander 14 may be left exposed outside of the frog 12 body in order to form a fanciful tongue therefor.

Figure 2:
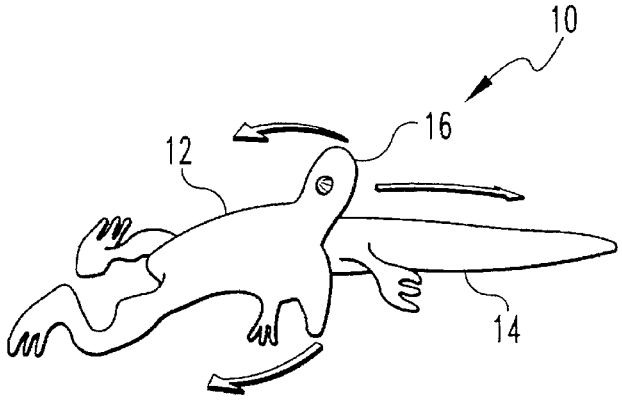
FIG. 2 is a perspective view of the first embodiment of the present invention near the beginning of a reversing operation.
Figure 3:
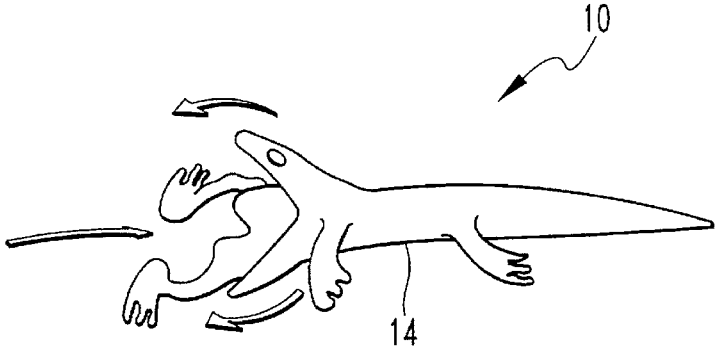
FIG. 3 is a perspective view of the first embodiment of the present invention near the end of the reversing operation.
Figure 4:
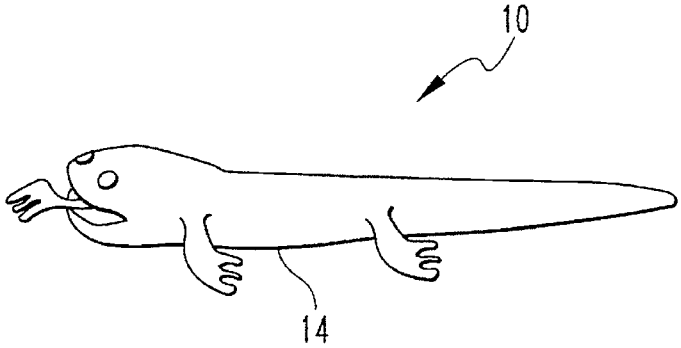
FIG. 4 is a perspective view of the first embodiment of the present invention with a second animal shape exposed.

As shown in FIG. 2, the reversing process begins by folding the wide mouth of the frog 12 open while simultaneously pulling the tail of the salamander 14 out of the frog's mouth. At this stage of the transformation, it appears that the frog 12 is regurgitating a salamander 14. As shown in FIG. 3, the reversal process continues as the frog's head flips completely over, thereby forming the head of the salamander 14. It will be appreciated by those skilled in the art from review of FIGS. 2–3 that the frog 12 and the salamander 14 share a common mouth. Therefore when the head of the frog 12 is flipped inside out, the head of the salamander 14 appears. At this stage, it now appears that the salamander 14 is consuming the frog 12. Referring now to FIG. 4, the remainder of the frog 12 body is then stuffed into the mouth of the salamander 14 and a rear leg of the frog 12 may be left outside of the mouth of the salamander 14 in order to form a fanciful tongue therefor. The toy 10 is transformed back into the frog 12 simply by reversing the steps illustrated in FIGS. 1–4.

Figure 5:
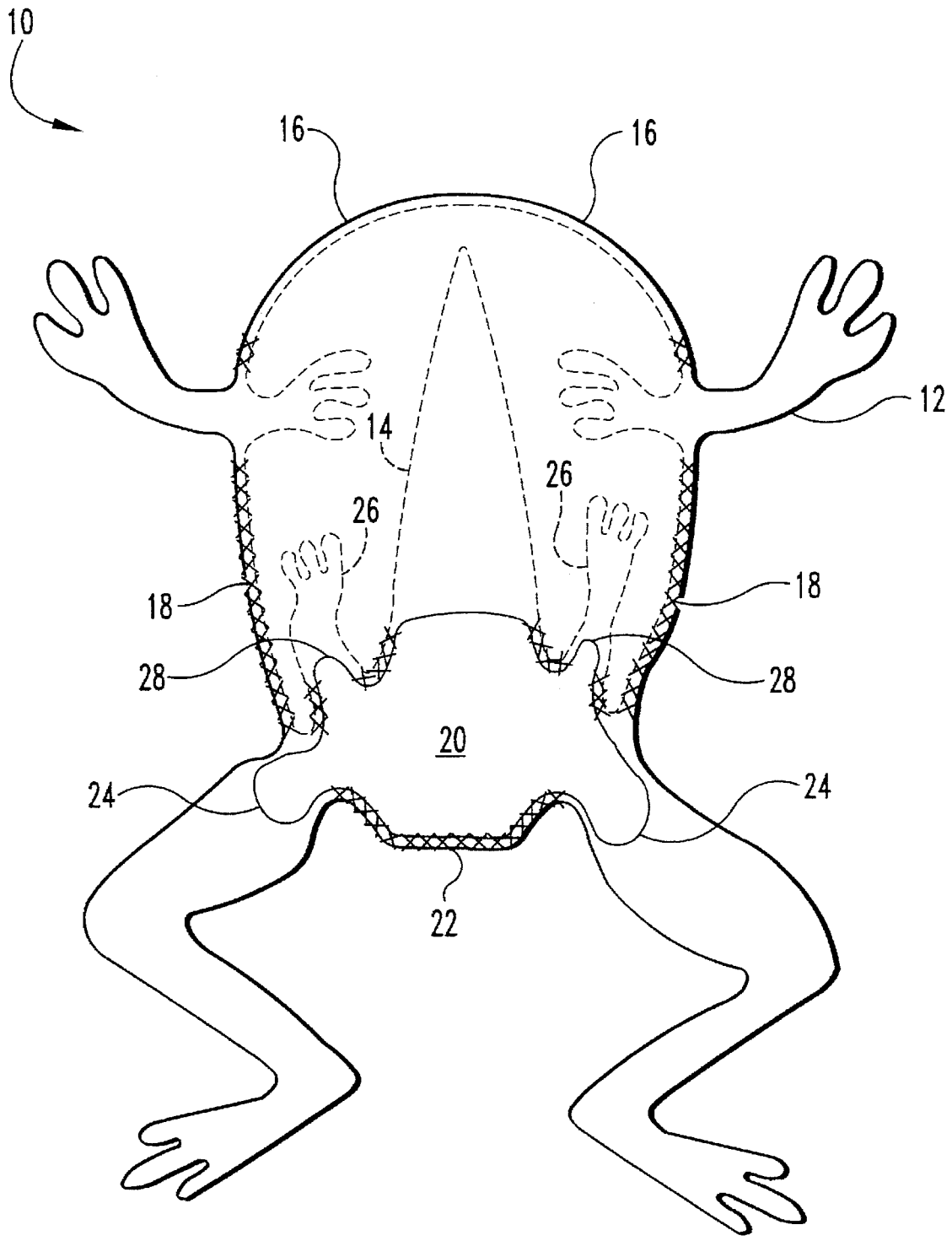
FIG. 5 is a top plan view of the first embodiment of the present invention with the first animal figure exposed.

Referring now to FIG. 5, a top plan view of the first embodiment toy 10 is illustrated with the frog 12 exposed. Visible within the frog 12 are the front and rear legs and tail of the salamander 14. Note that a portion of the tail may be left protruding from the frog 12 mouth. The frog 12 body and the salamander 14 body are preferably coupled together along the lips of the common mouth 16 and at the ribs/hips 18 of each animal, as indicated by the X's in the drawing figure. Other than in the region 16 and 18, there is no direct connection between the frog 12 and the salamander 14.

Figure 6:
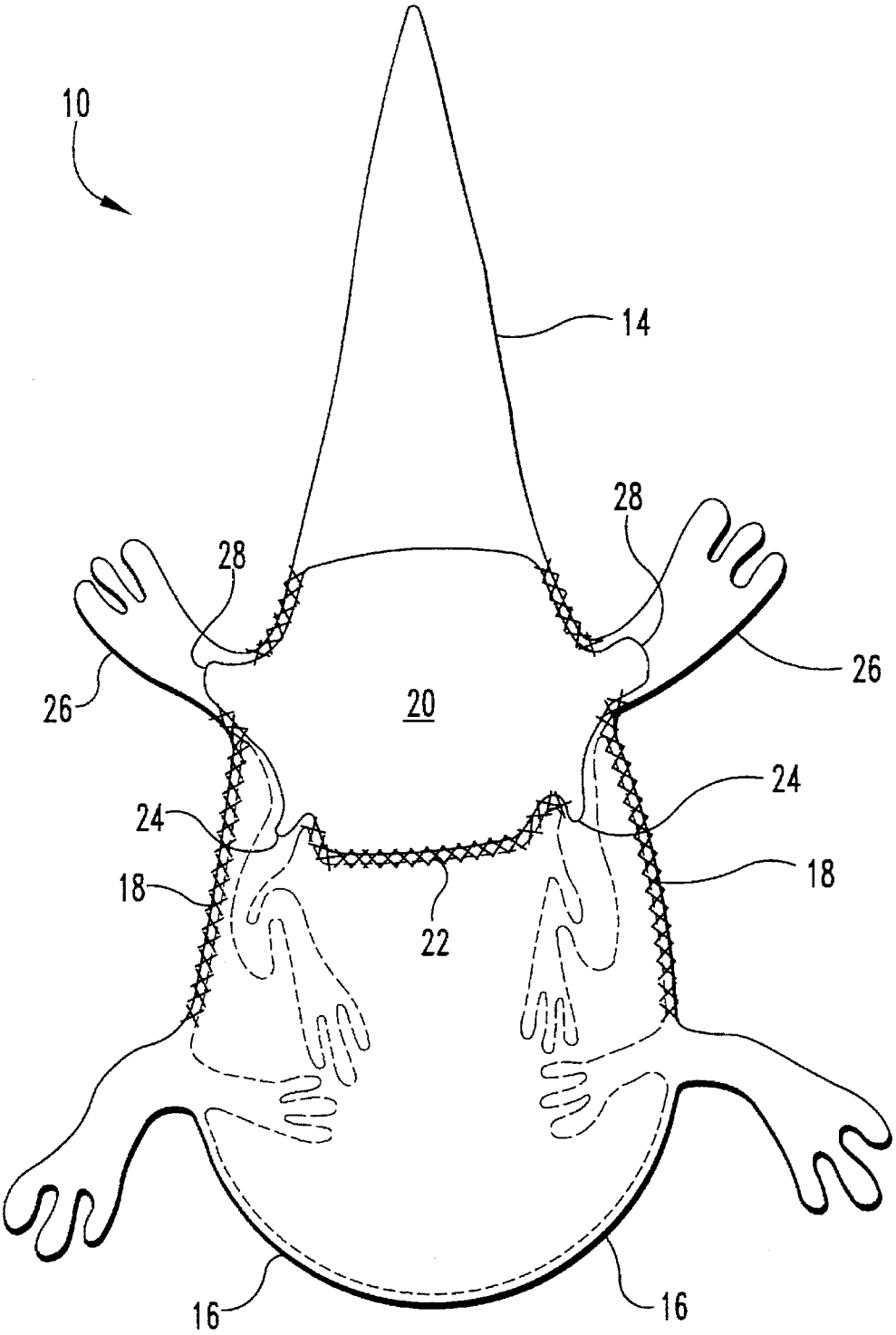
FIG. 6 is a top plan view of the first embodiment of the present invention with the second animal figure exposed.

An optional feature of the reversible plush toy 10 is the middle stiffening connector 20. As described in greater detail hereinbelow, the middle connector 20 is formed from two pieces of fabric sewn together around their periphery and optionally stuffed with a quilted batting material. The middle connector 20 is also joined to the frog 12 along the rear end 22 and to the salamander 14 on either side of the rear legs 26. It will be appreciated by those skilled in the art that if the salamander 14 was an animal without a tail (such as another frog), the middle connector would preferably be sewn along the length of the animal's rear end. As will be apparent from study of FIGS. 5 and 6, only the front half (the head, front legs and ribs/hips) of each animal actually flip and move during the transformation process. The rear legs of the frog 12 and salamander 14, the tail of the salamander 14, and the middle connector 20 remain relatively stationary as the head of the frog 12 is flipped thereover in order to transform into the head of the salamander 14 at the opposite end of the toy. The reversible toy 10 is illustrated in FIG. 6 with the salamander 14 exposed. Comparison of FIGS. 5 and 6 illustrate that it is only the head and front legs of each animal which traverse the length of the toy 10 in order to accomplish the transformation.

The middle stiffening connector 20 is optional and is used to add rigidity to the reversible toy 10. The middle connector 20 is preferably coupled to the frog 12 and the salamander 14 along the areas indicated by the X's. The middle connector 20 preferably includes a pair of protrusions 24 which extend into the rear legs of the frog 12 but do not attach to the rear legs. The middle connector 20 further preferably includes projections 28 which extend into the rear legs of the salamander 14 but do not attach thereto.

Figure 9:
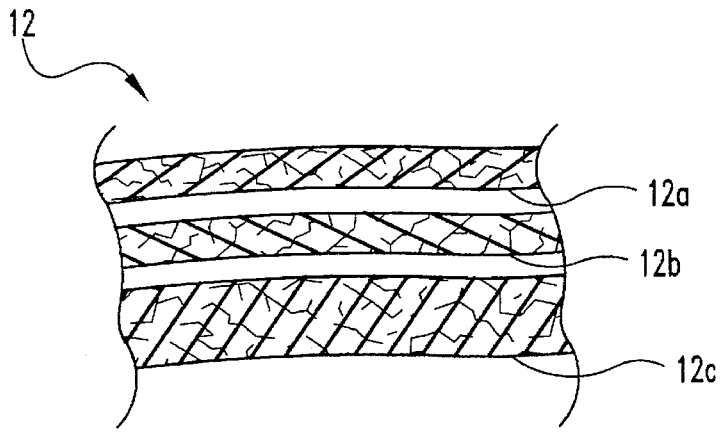
FIG. 9 is a cross-sectional view of a portion of the first animal figure, turned inside-out during assembly.
Figure 10:
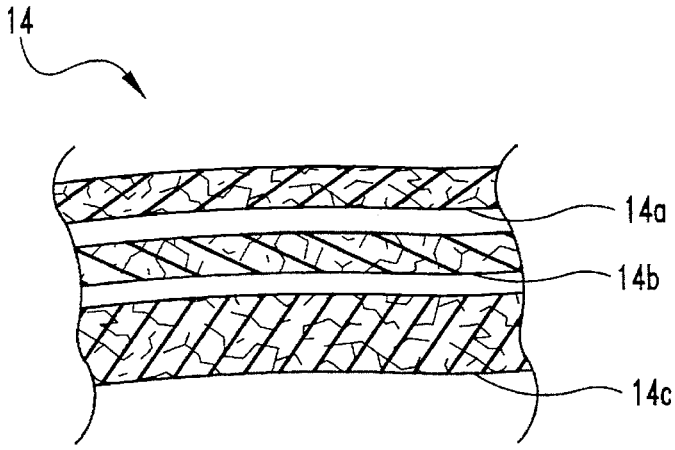
FIG 10. is a cross-sectional view of a portion of the second animal figure, turned inside-out during assembly.

Manufacture of the reversible plush toy 10 is preferably as follows. A pattern for the frog 12 body is drawn on the rear side of a first piece of frog fabric 12*a*. As shown in FIG. 9, the first piece of frog fabric 12*a* is then placed on top of a second piece of frog fabric 12*b* such that the front sides of both pieces of fabric face one another. These two pieces of fabric are then laid on top of a piece of stuffing material 12*c*, such as polyester quilt batting. These three pieces are then sewn to one another along the periphery of the frog pattern, leaving the mouth of the frog unsewn. Excess fabric is then cut away from the sewn portions. At this point, the frog 12 is inside out. The front and rear legs of the frog 12 are then turned right side out such that they extend into the cavity between the first and second flog fabrics. The main body cavity of the frog 12 remains inside out. As shown in FIG. 10, this process is then repeated with a salamander pattern and two pieces of salamander cloth and a second piece of quilt batting 14*c*. After sewing these fabrics together (except at the salamander mouth) and cutting away the excess material, the front and rear legs of the salamander are turned right side out such that they extend into the interior of the salamander body.

Figure 11:
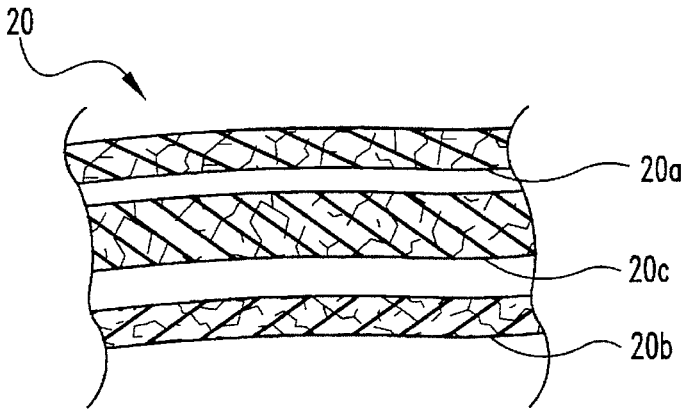
FIG. 11 is a cross-sectional view of a portion of a middle stiffening connector of the present invention.

The middle stiffening connector 20 is then formed by sewing two pieces of fabric 20*a* and 20*b* with stuffing 20*c* between them, as shown in FIG. 11. The middle connector is sewn together completely around its periphery. The appearance of the fabric for the middle connector 20 is not critical as the middle connector 20 remains on the interior of the toy 10 no matter what position the toy 10 is in.

One end of the middle connector 20 is sewn to the rear end 22 of the frog 12. While the frog 12 body is inside out. The opposite end of the middle connector 20 is then sewn to either side of the rear legs 26 and the base of the salamander 14 tail while the salamander body is inside out.

The ribs/hips 18 of the frog 12 and salamander 14 are then sewn together, as are the cheeks of the frog 12 and the salamander 14 (the cheeks are the areas which transition between the mouth 16 and the front legs of each animal). The two animal bodies are now secured to one another and each body can be turned inside out through its mouth. This process results in the mouth of each body being brought into alignment with the mouth of the other body near the center of the animal. Extra stuffing may be added to the interior of either animal at this time, after which the lips of the two animals are sewn together, sealing off the stuffing and the middle connector 20 between the shared body walls. The toy 10 is now ready to execute the transformation sequences illustrated in FIGS. 1–4.

Figure 7:
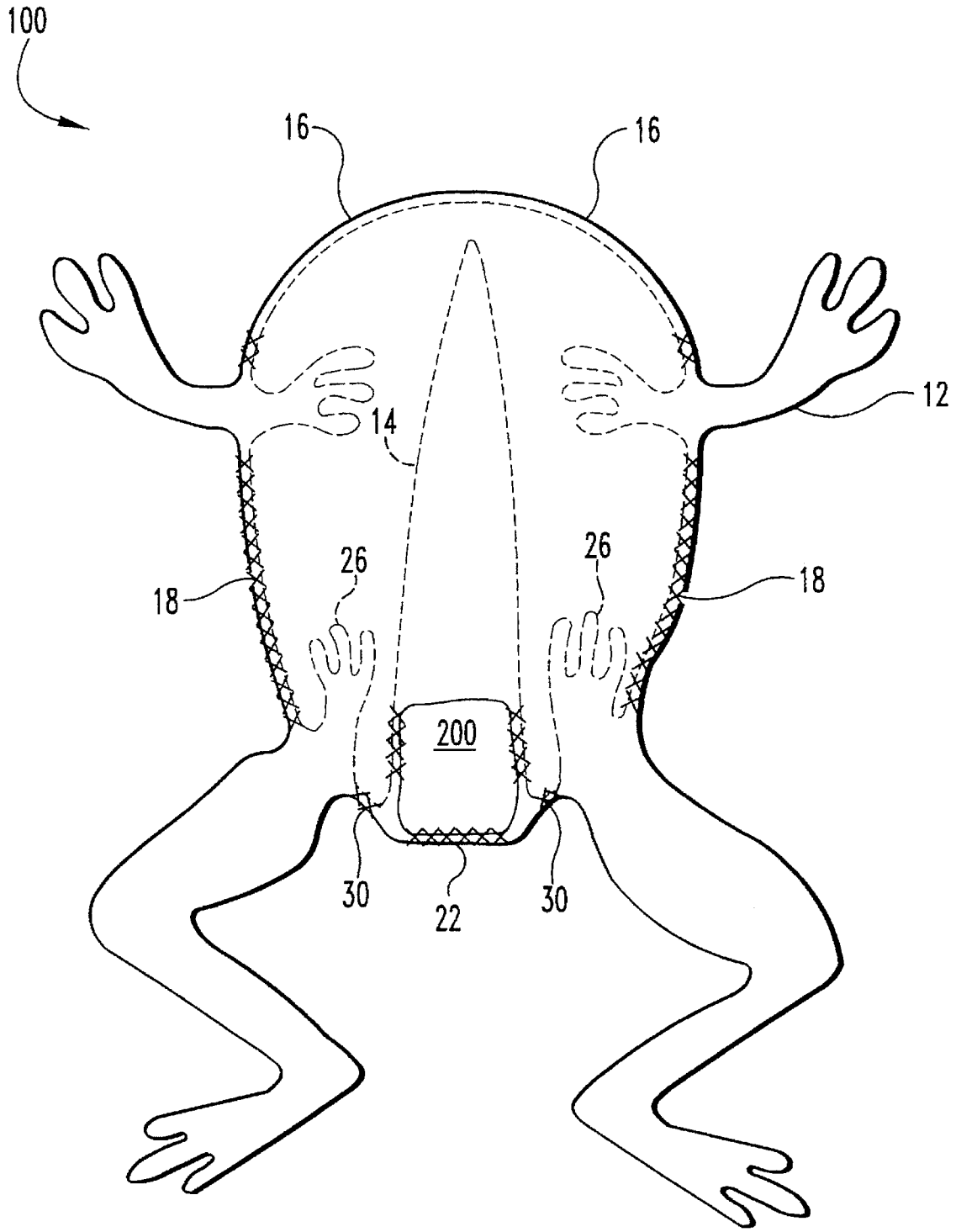
FIG. 7 is a top plan view of a second embodiment of the present invention.

Referring now to FIG. 7, a second embodiment to the present invention is illustrated and indicated generally at 100. The toy 100 is substantially similar to the first embodiment toy 10, with the exception that the middle stiffening connector 200 of the toy 100 is much smaller than the middle stiffening connector 20 of the toy 10. Specifically, the middle stiffening connector 200 omits the use of the protrusions 24 and 28 of the middle stiffening connector 20. With the smaller middle stiffening connector 200, the frog 12 and salamander 14 are preferably additionally coupled to one another at the areas 30, which lie on either side of the frog rear end 22 and the salamander tail. Otherwise, the second embodiment 100 is substantially similar to the first embodiment 10.

Figure 8:
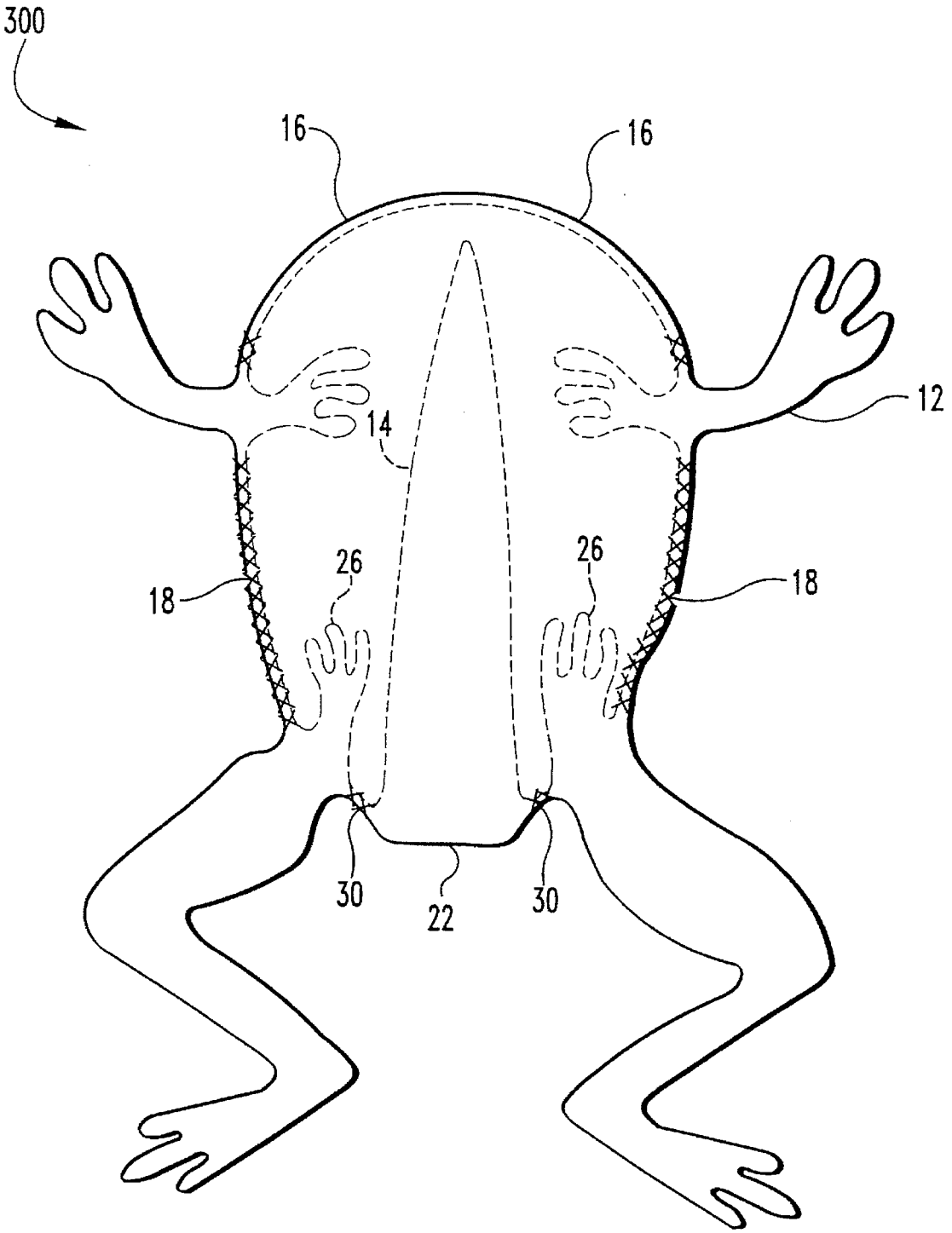
FIG. 8 is a top plan view of a third embodiment of the present invention.

Referring now to FIG. 8, a third embodiment of the present invention is illustrated and indicated generally at 300. The toy 300 is substantially similar to the toys 10 and 100, with the exception that the toy 300 omits the middle stiffening connector altogether. The toy 300 may be formed substantially identically to the toy 100 with the omission of the middle stiffening connector 200.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, the toy 10 has been illustrated herein as comprising a frog and a salamander. It will be appreciated by those skilled in the art that the present invention comprehends the use of any two designs in the toy 10, or even two of the same design. Furthermore, the present invention is not limited to the use of animal shapes, as the use of human figures joined at the mouth are equally easy to integrate into the design.

What is claimed is:

1. A reversible plush toy, comprising:

a first figure in a shape of a first character having a first face with a first mouth formed in the first face, the first figure having a hollow first shell; and a second figure in a shape of a second character having a second face with a second mouth formed in the second face, the second figure having a hollow second shell;

wherein the first and second mouths are coupled together, thereby coupling the first figure to the second figure, such that the second figure may be pushed through the first mouth and retained within the first shell and the first figure may be pushed through the second mouth and retained within the second shell.

2. The reversible plush toy of claim 1, wherein the first shell comprises at least one piece of fabric.

3. The reversible plush toy of claim 1, wherein the first shell comprises two pieces of fabric and a layer of stuffing therebetween.

4. The reversible plush toy of claim 3, wherein the stuffing comprises polyester quilted batting.

5. The reversible plush toy of claim 1, wherein the second shell comprises at least one piece of fabric.

6. The reversible plush toy of claim 1, wherein the second shell comprises two pieces of fabric and a layer of stuffing therebetween.

7. The reversible plush toy of claim 6, wherein the stuffing comprises polyester quilted batting.

8. The reversible plush toy of claim 1, further comprising:

a middle stiffening connector having a first end and a second end;

wherein the first end is coupled to an interior of the first shell and the second end is coupled to an interior of the second shell.

9. The reversible plush toy of claim 8, wherein the middle stiffening connector comprises two pieces of fabric and a layer of stuffing therebetween.

10. The reversible plush toy of claim 9, wherein the stuffing comprises polyester quilted batting.

11. The reversible plush toy of claim 8, further comprising:

at least one appendage formed in the hollow first shell; and at least one protrusion formed on the middle stiffening connector;

wherein the at least one protrusion extends partially into the at least one appendage.

12. The reversible plush toy of claim 1, wherein the first figure is formed in a frog shape and the second figure is formed in a salamander shape.

* * * * *

UNITED STATES PATENT AND TRADEMARK OFFICE

CERTIFICATE OF CORRECTION

PATENT NO. : 5,649,848

DATED : July 22, 1997

INVENTOR(S) : Stanton W. Clark

It is certified that error appears in the above-identified patent and that said Letters Patent is hereby corrected as shown below:

In column 2, line 23, please change "FIG 10." to --FIG. 10--.

In column 3, line 61, please change "flog" to --frog--.

Signed and Sealed this

Fourth Day of November, 1997

*Attest:*

*Attesting Officer*

BRUCE LEHMAN

*Commissioner of Patents and Trademarks*